US006627136B2

(12) United States Patent
Frey, Jr.

(10) Patent No.: US 6,627,136 B2
(45) Date of Patent: Sep. 30, 2003

(54) METHOD FOR MAKING A LIQUID STORAGE TANK

(75) Inventor: Charles A. Frey, Jr., Lititz, PA (US)

(73) Assignee: Bigbee Steel and Tank Company, Manheim, PA (US)

( * ) Notice: Subject to any disclaimer, the term of this patent is extended or adjusted under 35 U.S.C. 154(b) by 74 days.

(21) Appl. No.: 09/845,652

(22) Filed: Apr. 30, 2001

(65) Prior Publication Data

US 2001/0038013 A1 Nov. 8, 2001

Related U.S. Application Data

(60) Provisional application No. 60/201,947, filed on May 5, 2000.

(51) Int. Cl.[7] ..... B29C 39/10

(52) U.S. Cl. ..... 264/269; 264/270; 264/310; 264/319

(58) Field of Search ..... 264/267, 269, 264/270, 310, 319

(56) References Cited

U.S. PATENT DOCUMENTS

| | | | | | |
|---|---|---|---|---|---|
| 2,641,218 | A | | 6/1953 | Burwell | |
| RE24,187 | E | | 7/1956 | Burwell | |
| 3,498,820 | A | | 3/1970 | Hawkins | |
| 4,609,120 | A | * | 9/1986 | Lauer et al. | 220/69 |
| 5,221,022 | A | | 6/1993 | Frey, Jr. et al. | |
| 5,379,507 | A | * | 1/1995 | Lindahl | 29/460 |
| 5,686,141 | A | | 11/1997 | Haldenby | |
| 5,728,423 | A | | 3/1998 | Rogerson | |

* cited by examiner

*Primary Examiner*—Edmund H. Lee
(74) *Attorney, Agent, or Firm*—Paul Beck & Associates

(57) ABSTRACT

A method for making a liquid storage tank for holding chemicals and heating oil and water and liquids compatible with high-density polyethylene. The tank is lap welded with a perforation in the lap weld and contains a molded polyethylene lining inside the tank.

4 Claims, 2 Drawing Sheets

METHOD FOR MAKING A LIQUID STORAGE TANK

Applicant is claiming the benefit of the prior filed Provisional Application No. 60/201,947 filed on May 5, 2000.

BACKGROUND OF THE INVENTION

1. Field of the Invention

This invention relates to a liquid storage vessel or tank and particularly to a welded vessel used for the storage of chemicals, heating oil, water, and liquids compatible with high density polyethylene.

2. Description of the Related Art

Steel basement tanks have been in existence for many years. These types of tanks have primarily been used for storage of heating oils. A major drawback for a steel storage tank is that condensation that naturally occurs in the tank causes water to gather at the bottom of the tank. The presence of the water in conjunction with microbial growth that is often present in fuel oil, can cause bacteria to grow which can deteriorate the steel shell of the tank.

Steel tanks can only be used store certain chemicals. Some chemicals react with steel and therefore can not be stored in standard steel tanks.

Additionally in steel tanks used to store chemicals that do not react with steel, condensation causes water to gather on the top and bottom surface of the tank and this can cause imperfections to grow and small portions of the steel to react and thereby adding impurities into the liquid itself and/or cause corrosion of the tank itself.

Many methods have been used with varying success to eliminate moisture in tanks such as desiccant filters and sloping the tank to a drain to remove moisture at the bottom of the tank. These methods work in some cases but not all. The best attempt to solve the problem is to place a person entry known as a manway into a tank, grit blasting the inside of the tank, and applying a liquid based coating to the inside of the tank. This has been done in the industry for years. However for smaller tanks this is cost prohibitive therefore creating a need to find a method for protecting the inside of the tank without having to have a person physically enter the tank.

There is no known effective method or apparatus for protecting the inside of the tank from condensation and water build up without having a person enter the inside of the tank.

The present invention solves this problem by coating a lap welded tank with a perforation in the lap weld with granular polyethylene and then heating the tank. The polyethylene also makes it possible to store chemicals that react with steel.

SUMMARY OF THE INVENTION

The present invention provides a liquid storage tank for holding chemicals and heating oil and water and liquids compatible with high-density polyethylene. The tank is lap welded with a perforation in the lap weld. The tank also has a polyethylene lining inside of the tank that assumes the shape of the interior of tank. The polyethylene lining may have sufficient strength to hold its shape independent of the tank.

The invention also provides for a liquid storage tank where the perforation is welded closed.

The present invention provides a method for making a liquid storage tank for holding chemicals and heating oils and water and liquids compatible with high-density polyethylene by providing a tank having an opening to receive fluid with lap welded joints and a perforation in the lap joint on each of a cross seam joint and a circumferential joint of the tank. Polyethylene in granular form is inserted into the tank. The tank is heated which causes the polyethylene to melt. The tank can be heated between 300–600° F. The tank can also be rotated while it is being heated. The perforations are then welded closed.

DETAILED DESCRIPTION OF A PREFERRED EMBODIMENT

Definitions

"Liquid Storage Tank" means a vessel for containing liquids.

"Chemicals" means any liquid.

"Heating Oils" means #2 fuel oil or used motor oil used for heating.

"Liquids" means a substance not in a solid or gaseous state.

"High-Density Polyethylene" means a partially crystalline lightweight thermoplastic.

"Lap Welded" means steel joined by means of placing plates together by over lapping them and welding the joint created.

"Perforation" means a hole through a material.

"Polyethylene Lining" means a thermoplastic layer insulating the product stored from the steel tank.

"Granular" means consisting of or appearing to consist of granules.

"Cross Seam Joint" means a straight seam transverseing longitudinally across the tank.

"Circumferential" means a non straight seam transverseing in a generally circumferential direction around the tank.

Description

Figure 1:
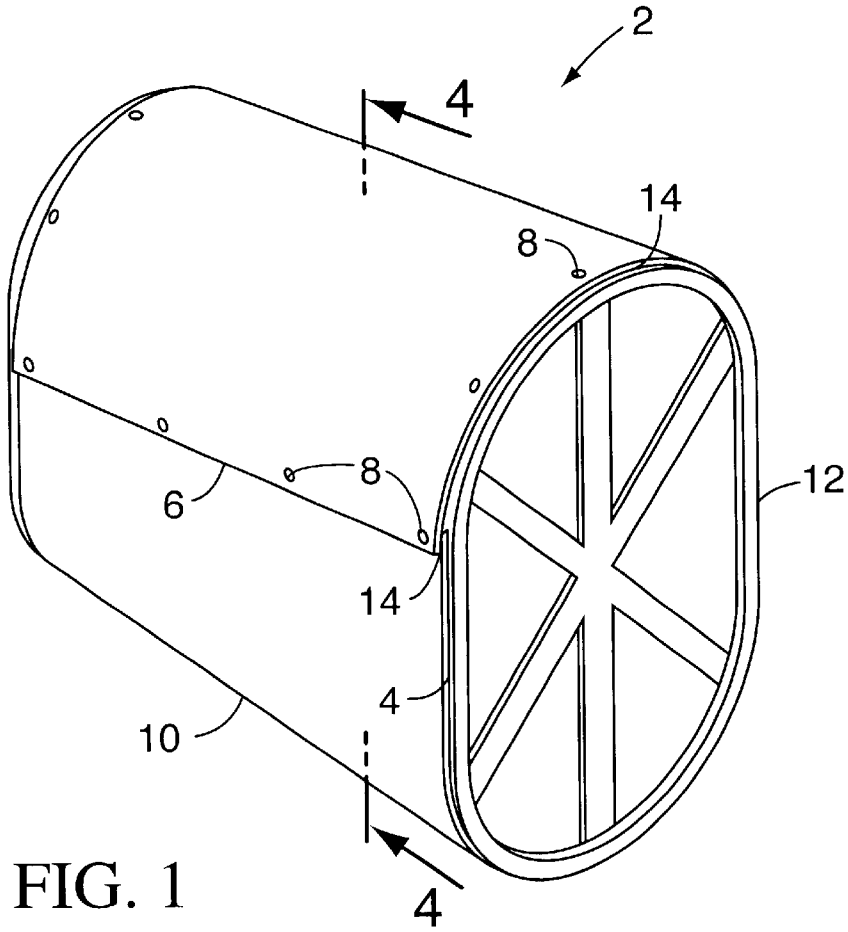
FIG. 1 An isometric view of a liquid storage tank.
Figure 2:
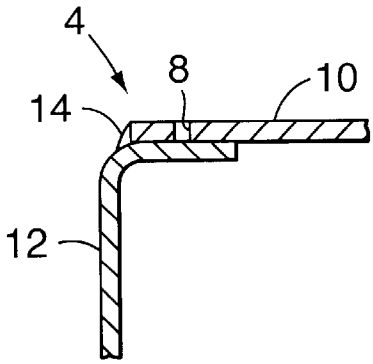
FIG. 2 A side view in section and in elevation of a circumferential lap joint.
Figure 3:
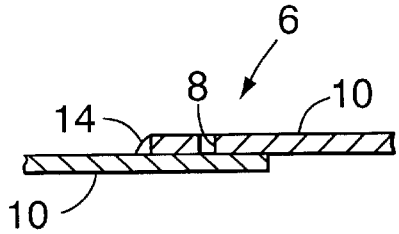
FIG. 3 A side view in section and in elevation of a cross seam joint.

FIG. 1 shows a liquid storage tank 2 with a circumferential joint 4 and a cross seam joint 6. Both the circumferential joint 4 and the cross seam joint 6 are lap welded 14 and contain a perforation 8 as shown in FIGS. 2 and 3. The circumferential joint 4 attaches a shell 10 of the tank 2 to a head 12 of the tank 2. The cross seam joint 6 joins both sides of the shell to together. The inside of the tank is lined with a polyethylene lining (Lining not shown in FIG. 1.).

FIG. 2 shows a circumferential joint 4 joining the shell 10 and the head 12 together through a lap weld 14. The joint has a perforation 8.

FIG. 3 shows a cross seam joint 6 joining the two sides of the shell 10 together through a lap weld 14. The joint has a perforation 8.

Figure 4:
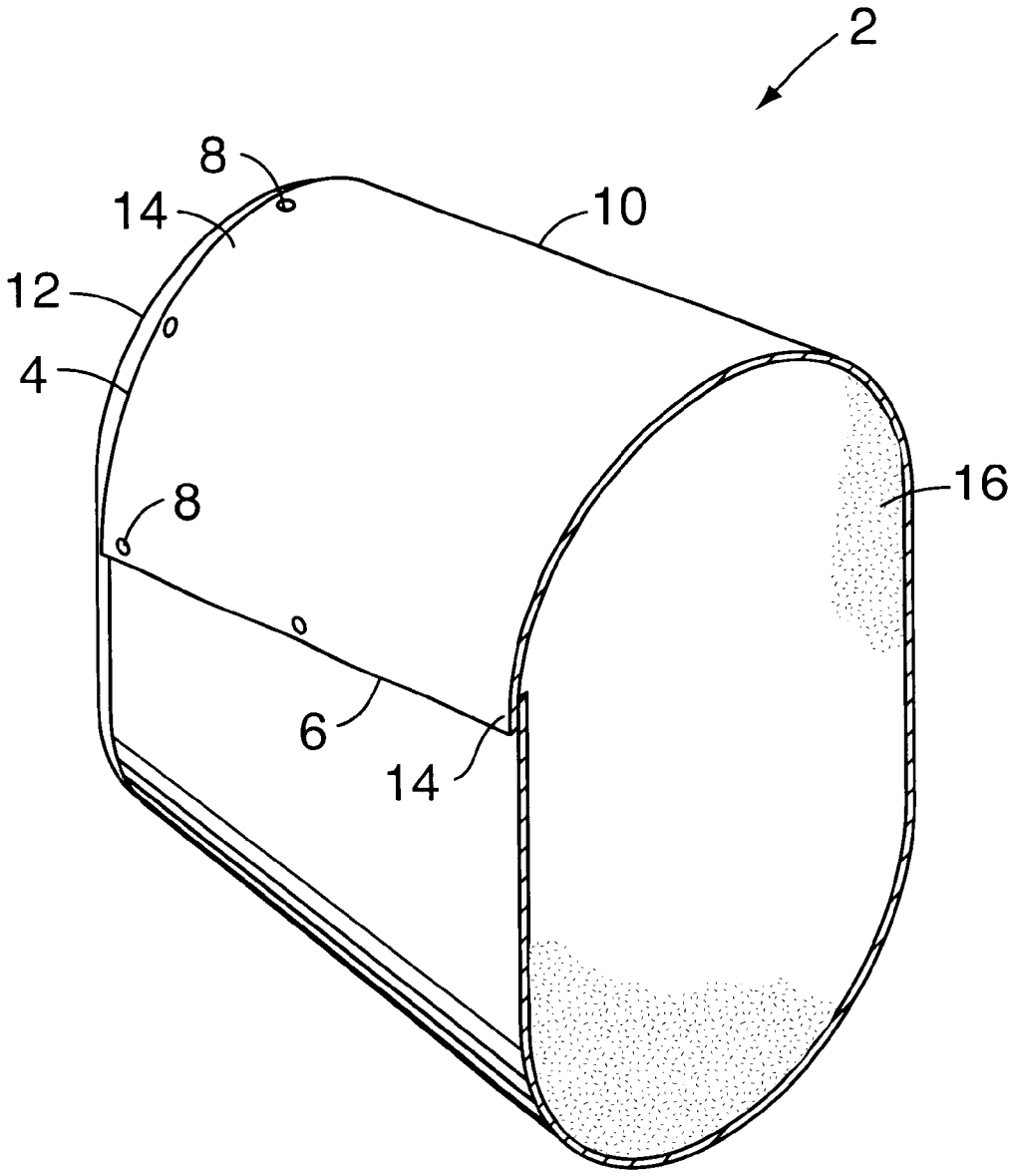
FIG. 4 A isometric view of liquid storage tank in section along line IV—IV of FIG. 1.

FIG. 4 shows a liquid storage tank 2 in isometric section along line IV—IV of FIG. 1 with a circumferential joint 4 and a cross seam joint 6. Both the circumferential joint 4 and the cross seam joint 6 are lap welded 14 and contain a perforation 8 as shown in FIGS. 2 and 3. The circumferential joint 4 attaches a shell 10 of the tank 2 to a head 12 of the tank 2. The cross seam joint 6 joins both sides of the shell 10 together. The inside of the tank 2 is lined with a polyethylene lining 16 with sufficient strength to hold its shape independently of the tank 2. The polyethylene lining 16 is formed by placing granular polyethylene into the tank 2. The tank is then heated causing the granular polyethylene to melt and form the polyethylene lining 16. The tank 2 is preferably heated to a temperature of 300–600° F. The tank 2 can be rotated while being heated. The perforation 8 is then welded closed on both the circumferential joint 4 and the cross seam joint 6 after the tank has been cooled.

The perforation 8 is necessary to let air pressure out of the tank 2 during heating and cooling. If there is no perforation 8 in circumferential joint 4 and the cross seam joint 6, when the tank 2 cools the polyethylene lining 16 will be pulled into the cross seem joint 6 and the circumferential joint 4 which tears the lining 16. If this occurs the lining 16 will not be effective for preventing deterioration of the tank 2.

I claim:

1. A method for making a liquid storage tank for holding chemicals and heating oil and water and liquids compatible with high-density polyethylene comprising:

(a) providing a tank having an opening to receive fluid with lap welded joints and a perforation in the lap joint on each of a cross seam joint and a circumferential joint of the tank;

(b) inserting polyethylene in granular form into the tank;

(c) heating the tank causing the polyethylene to melt;

(d) molding an interior lining from the melted polyethylene that assumes the shape of the interior of the tank;

(e) cooling the tank and the molded lining; and (f) welding the perforations closed after cooling the tank and the molded lining.

2. The method as recited in claim 1 including rotating the tank while it is being heated.

3. The method as recited in claim 1 wherein the tank is heated to a temperature between 300–600° F.

4. The method as recited in claim 3 wherein the tank is rotated while maintained at a temperature between 300–600° F.

* * * * *